US010477951B2

(12) United States Patent
Chan

(10) Patent No.: US 10,477,951 B2
(45) Date of Patent: Nov. 19, 2019

(54) ENVIRONMENTAL-FRIENDLY PAINTBRUSH WITHOUT BRISTLE-IMPLANTING HOLES AND ITS PROCESSING METHOD

(71) Applicant: HUBEI C.P. NC MACHINERY LTD., Anlu, Hubei (CN)

(72) Inventor: Wing Chi Chan, Hubei (CN)

(73) Assignee: HUBEI C.P. NC MACHINERY LTD., Anlu (CN)

( * ) Notice: Subject to any disclaimer, the term of this patent is extended or adjusted under 35 U.S.C. 154(b) by 476 days.

(21) Appl. No.: 15/448,615

(22) Filed: Mar. 3, 2017

(65) Prior Publication Data

US 2017/0202346 A1 Jul. 20, 2017

(30) Foreign Application Priority Data

Apr. 25, 2016 (CN) ..... 2016 1 0259333

(51) Int. Cl.

| | |
|---|---|
| ***A46B 3/12*** | (2006.01) |
| ***A46D 3/04*** | (2006.01) |
| ***A46D 3/08*** | (2006.01) |
| ***A46B 5/02*** | (2006.01) |

(52) U.S. Cl.

CPC ..... *A46B 3/12* (2013.01); *A46D 3/047* (2013.01); *A46D 3/087* (2013.01); *A46B 2200/202* (2013.01)

(58) Field of Classification Search

CPC .... A46B 2200/202; A46B 3/12; A46D 3/047; A46D 3/087

See application file for complete search history.

(56) References Cited

U.S. PATENT DOCUMENTS 1,499,507 A * 7/1924 Crummett ..... A46B 3/12 15/177
2,948,910 A * 8/1960 Hulla ..... A46B 11/0093 15/159.1
3,090,063 A * 5/1963 Hunt ..... A46B 15/00 15/193
4,237,579 A * 12/1980 Salmon ..... A46B 9/10 15/166

(Continued)

FOREIGN PATENT DOCUMENTS

GB 190921811 A * 1/1910 ..... A46B 3/12
GB 704590 A * 2/1954 ..... A46B 3/02

*Primary Examiner* — Marc Carlson

(57) ABSTRACT

An environmental-friendly paintbrush without bristle-implanting holes includes a handle, a bristle-implanting brush head, and a metal plate. The bristle-implanting brush head may have one end provided with a bristle material-laying trough, and another end connected with the handle. A plastic block may be placed inside the bristle material-laying trough. Bristle material may be filled in an interstitial space between the plastic block and the bristle-implanting brush head. The plastic block is formed with a metal-laying trough. The metal plate is set inside the metal-laying trough. Two ends of the bristle material-laying trough are formed with metal slots provided inside the brush-implanting brush head. Two ends of the metal plate are slotted into the metal slots. A method of processing an environmental-friendly paintbrush without bristle-implanting holes is also disclosed.

8 Claims, 2 Drawing Sheets

(56) References Cited

U.S. PATENT DOCUMENTS

| | | | | | |
|---|---|---|---|---|---|
| 5,435,037 | A * | 7/1995 | Ledingham | A46B 7/04 | 15/168 |
| 5,678,276 | A * | 10/1997 | Ledingham | A46B 3/02 | 15/168 |
| 6,035,481 | A * | 3/2000 | Douglas | A46B 3/12 | 15/168 |
| 6,295,685 | B1 * | 10/2001 | Douglas | A46B 3/12 | 15/146 |
| 6,332,235 | B1 * | 12/2001 | Lye | A46B 7/04 | 15/176.1 |
| 2014/0304931 | A1 * | 10/2014 | Cox | A46B 17/08 | 15/159.1 |

* cited by examiner

ENVIRONMENTAL-FRIENDLY PAINTBRUSH WITHOUT BRISTLE-IMPLANTING HOLES AND ITS PROCESSING METHOD

CROSS REFERENCE TO RELATED APPLICATIONS

The present application claims the benefit of Chinese Patent Application No. 201610259333.5 filed on Apr. 25, 2016. All the above are hereby incorporated by reference.

FIELD OF THE TECHNOLOGY

The present application relates to the structure of a paintbrush, and particularly to an environmental-friendly paintbrush without bristle-implanting holes. The present application further relates to a method of processing an environmental-friendly paintbrush without bristle-implanting holes.

BACKGROUND

When producing a paintbrush under the current technology, one needs to first form a number of bristle-implanting holes on the handle of the paintbrush, and then set bristle material in the bristle-implanting holes.

In order to increase the firmness of the bristle material on the handle under the current technology, and prevent the falling of the bristle material from the handle, one needs to apply glue so as to bond the bristles and the handle together. When processing a single paintbrush according to the above-mentioned current technology, more time needs to be spent on forming the bristle-implanting holes (average total time needed to form the bristle-implanting holes for each paintbrush is 15 seconds). It also requires a large amount of glue, and is therefore not environmental-friendly.

In the process of producing a paintbrush, not forming bristle-implanting holes and not applying glue is a technical issue that people always want to solve.

SUMMARY

A first object of the present application is to overcome the shortcomings of the background technology by providing an environmental-friendly paintbrush without bristle-implanting holes, which solves the difficult issue of always wanting to produce a paintbrush without forming bristle-implanting holes and without application of glue.

A second object of the present application is to overcome the shortcomings of the background technology by providing a method of processing an environmental-friendly paintbrush without bristle-implanting holes, which solves the issue of always wanting to produce a paintbrush without forming bristle-implanting holes and without application of glue.

To achieve the object of the present application, the technical solution is to produce an environmental-friendly paintbrush without bristle-implanting holes, characterized in having a handle, a bristle-implanting brush head, and a metal plate. The bristle-implanting brush head may have one end provided with a bristle material-laying trough, and another end connected with the handle. A plastic block may be placed inside the bristle material-laying trough. Bristle material may be filled in an interstitial space between the plastic block and the bristle-implanting brush head. The plastic block is formed with a metal-laying trough. The metal plate is set inside the metal-laying trough. Two ends of the bristle material-laying trough are formed with metal slots provided inside the brush-implanting brush head. Two ends of the metal plate are slotted into the metal slots.

In the above technical solution, the plastic block has a V-shaped cross section, the plastic block having one end located at a bottom end of the bristle-laying trough and another end provided with the metal-laying trough, the metal-laying trough being "I" shaped in cross section.

In the above technical solution, the metal plate is provided with a sawtooth trough at two ends thereof.

In the above technical solution, the bristle-implanting brush head and the handle are made of plastic, and the bristle-implanting brush head and the handle are unitary in structure.

In the above technical solution, the handle is provided with a positioning column or a positioning trough, the bristle-implanting brush head is provided with a corresponding positioning trough or a corresponding positioning column, and the bristle-implanting brush head is snapped onto the handle via the positioning trough and the positioning column.

In the above technical solution, detent pieces are provided on the positioning column, the positioning column is in mating connection with the positioning trough via the detent pieces.

In the above technical solution, the bristle-implanting brush head is made of plastic, and the handle is made of plastic or wood.

In the above technical solution, the metal plate is selected from the group consisting of iron plate, steel plate, stainless iron and copper plate.

To achieve the second object of the present application, the technical solution is to provide a method of processing an environmental-friendly paintbrush without bristle-implanting holes, wherein the processing includes the steps of: Step 1: preparing a handle and a bristle-implanting brush head, and placing bristle material on one side of a machine; Step 2: placing the bristle-implanting brush head in a material-loading trough of a paintbrush processing device, and filling up a bristle container of the paintbrush processing device with the bristle material; Step 3: turning on a switch of the paintbrush processing device, selecting auto mode function, and allowing the machine to run; Step 4: when a driving shaft of the paintbrush processing device rotates to a position where the bristle-implanting brush head is located, and the bristle-implanting brush head is precisely facing a gripping jaw of a handle-loading mechanism, the handle-loading mechanism places the bristle-implanting brush head into the gripping jaw and the bristle-implanting brush head is tightly gripped by the gripping jaw, and at this time the bristle-implanting brush head is located at a handle-loading station; Step 5: when the driving shaft drives the bristle-implanting brush head to rotate from the handle-loading station to a next station, detecting whether a bristle-implanting brush head is present on the driving shaft, and if a handle is present then bristle implanting is carried out in the next station, and if a handle is not present, then no bristle implanting is carried out; Step 6: setting the bristle material at an opening of a bristle material-laying trough, pressing the bristle material into the bristle material-laying trough by a plastic block which carries a metal plate, and tightly clamping the plastic block and the bristle-implanting brush head together via the metal plate; Step 7: rotating the bristle material to a bristle-shearing station and carrying out a first bristle-shearing of the bristle material, and after the first bristle-shearing of the bristle material is completed, rotating the bristle material again to an abrading station and carrying out abrading of the bristle material; Step 8: after abrading of the bristle material is completed, rotating the bristle material to the bristle-shearing station, and carrying out a second bristle-shearing of the bristle material; Step 9: after the second bristle-shearing of the bristle material is completed, rotating the bristle-implanting brush head to the handle-loading station again via the driving shaft, inserting a positioning column of the handle or the bristle-implanting brush head into a positioning trough of the bristle-implanting brush head or the handle, and at this time the handle and the bristle-implanting brush head are combined together; and Step 10: releasing the handle and checking package.

In actual operation, the metal plate is preferably an iron plate. The metal plate may be rectangular in shape. The two ends of the metal plate are inserted into the metal-laying trough for holding the bristle material and providing tension force.

The plastic block inside the bristle material-laying trough forms a space in the middle of the bristle material after bristle implanting. This can reduce the sturdiness and firmness of the bristle material, and can make the bristle material soft.

Each of the two ends of the metal plate is provided with a sawtooth trough (preferably inverted tooth trough). The advantage is that, after the metal plate is inserted into the metal-laying trough, the bristle-implanting brush head can press firmly against the slits of the sawtooth trough because of its flexibility, thereby holding the two ends of the metal plate, and generating tension with the metal plate. Hence, it requires a greater pulling force to pull out the bristle material from the bristle material-laying trough.

It requires only 2-3 seconds to assemble the paintbrush of the present application. It allows an operator to operate a number of machines (e.g. 10 machines) simultaneously, substantially increases productivity, and solves the issue of always wanting to produce a paintbrush without forming bristle-implanting holes and without application of glue.

Also, the paintbrush of the present application adopts bristle-implanting by a metal plate. It does not require glue during assembly. This is environmental-friendly, free of pollution, steady in structure, and easy to assemble. The density of the bristle material can satisfy actual production requirement. When in use, paint can hide in the space in the bristle material and flow out slowly such that paint is more even with less force to be applied.

In the figures, 1—handle, 2—bristle-implanting brush head, 3—metal plate, 4—bristle material-laying trough, 5—plastic block, 6—bristal material, 7—metal-laying trough, 8—metal slots, 9—inverted tooth trough, 10—positioning column, 11—positioning trough, 12—detent pieces

DETAILED DESCRIPTION

Specific embodiments will be described below with reference to the accompanying drawings. However, the paintbrush of present application is not limited to these specific embodiments which are only examples. The advantages of the paintbrush of the present application will be more clear and easy to understand by way of the following description.

Figure 1:
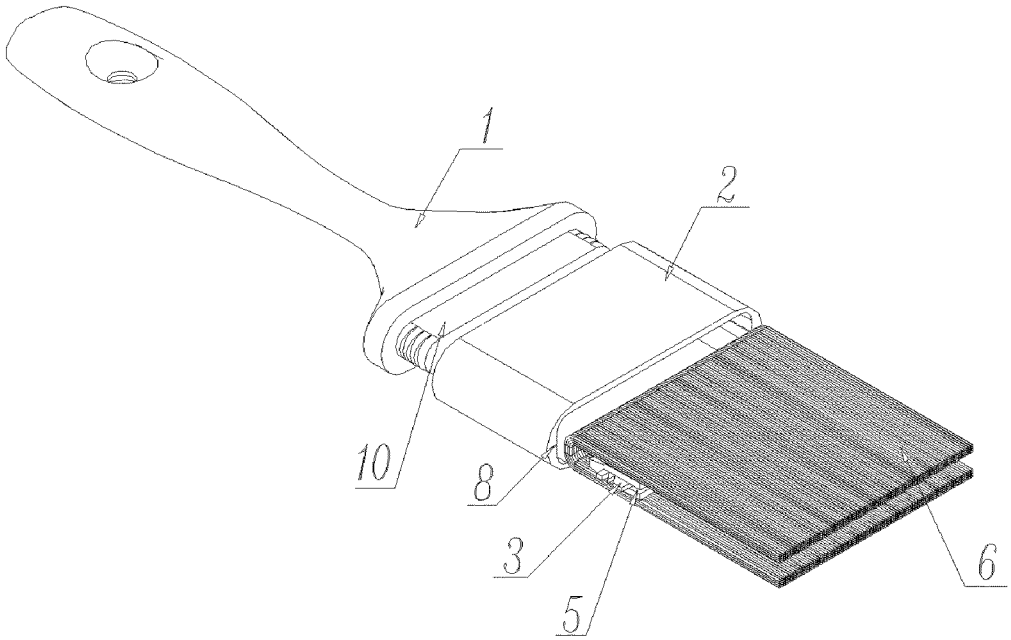
FIG. 1 is a perspective view of the environmental-friendly paintbrush without bristle-implanting holes of the present application when the handle and the bristle-implanting brush head are not assembled together.
Figure 2:
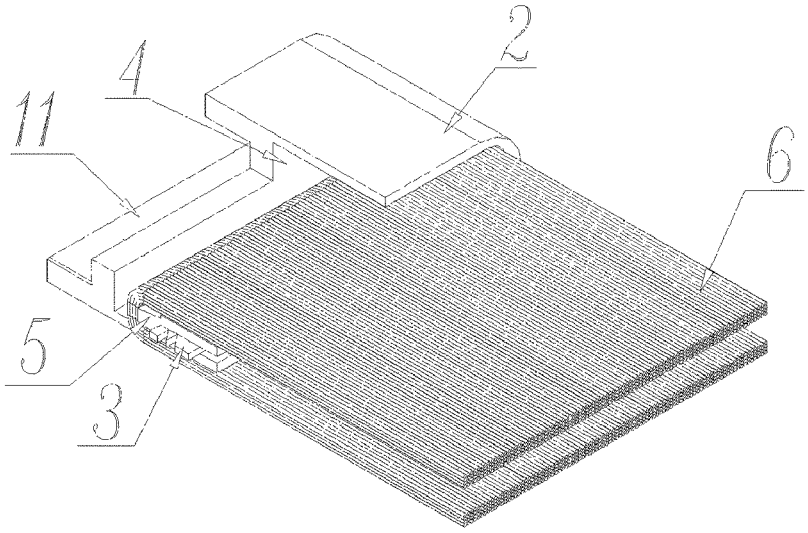
FIG. 2 is a perspective view of the environmental-friendly paintbrush without bristle-implanting holes of the present application when the bristle-implanting brush head is in a partial cutaway state and the handle is removed.
Figure 3:
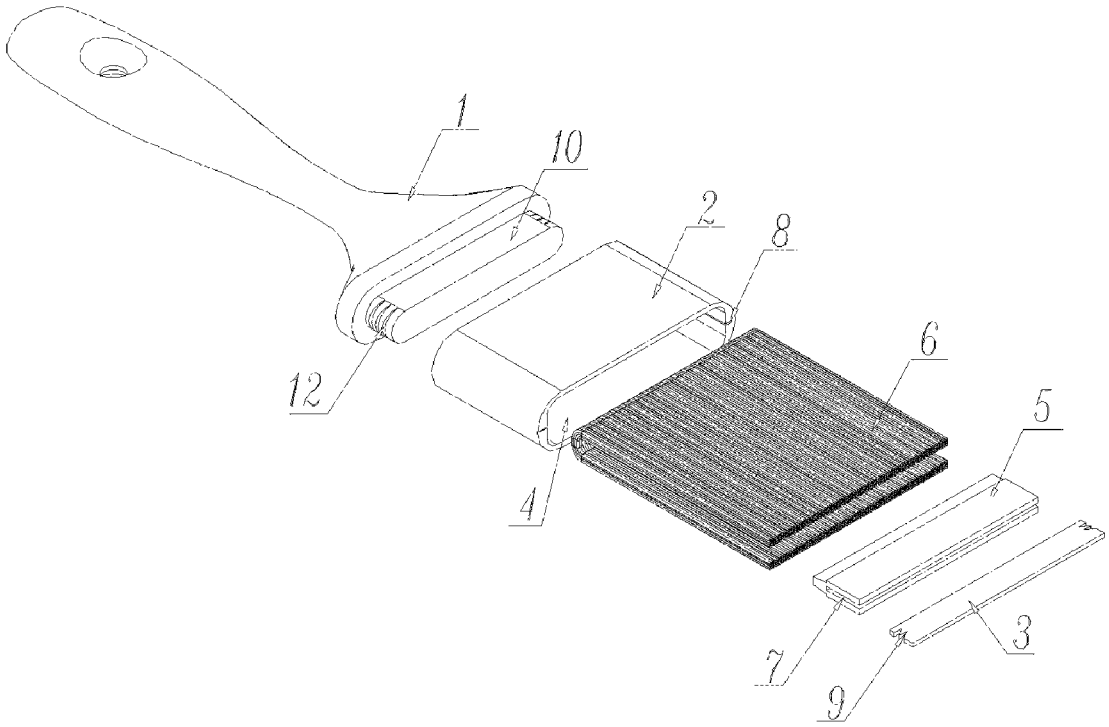
FIG. 3 is an exploded view of the environmental-friendly paintbrush without bristle-implanting holes of the present application.

As understood by referring to the accompanying FIGS. 1-3, an environmental-friendly paintbrush without bristle-implanting holes may include a handle 1, a bristle-implanting brush head 2, and a metal plate 3. The bristle-implanting brush head 2 may have one end provided with a bristle material-laying trough 4, and another end connected with the handle 1. A plastic block 5 may be placed inside the bristle material-laying trough 4. Bristle material 6 may be filled in an interstitial space between the plastic block 5 and the bristle-implanting brush head 2. The plastic block 5 may be formed with a metal-laying trough 7. The metal plate 3 may be set inside the metal-laying trough 7. Two ends of the bristle material-laying trough 4 may be formed with metal slots 8 provided inside the brush-implanting brush head 2. Two ends of the metal plate 3 can be slotted into the metal slots 8.

Preferably, the plastic block 5 may have a V-shaped cross section. The plastic block 5 may have one end located at a bottom end of the bristle material-laying trough 4 and another end provided with the metal-laying trough 7. The metal-laying trough 7 may be "I" shaped in cross section.

Preferably, the metal plate 3 may be provided with a sawtooth trough 9 at two ends thereof. Preferably, the metal plate 3 may be selected from the group consisting of iron plate, steel plate, stainless iron and copper plate.

Preferably, the bristle-implanting brush head 2 and the handle 1 may be made of plastic. The bristle-implanting brush head 2 and the handle 1 may be unitary in structure. Preferably, the bristle-implanting brush head 2 may be made of plastic, and the handle 1 may be made of plastic or wood.

Preferably, the handle 1 may be provided with a positioning column 10 or a positioning trough 11, and the bristle-implanting brush head 2 may be provided with a corresponding positioning trough 11 or a corresponding positioning column 10. The bristle-implanting brush head 2 can be snapped onto the handle 1 via the positioning trough 11 and the positioning column 10. Detent pieces 12 may be provided on the positioning column 10. The positioning column 10 can be in mating connection with the positioning trough 11 via the detent pieces 12. In actual construction, the detent pieces 12 may be provided in the positioning trough 11.

A method of processing the paintbrush of the present application may include the steps of:

- Step 1: preparing a handle 1 and a bristle-implanting brush head 2, and placing bristle material 6 on one side of a machine;
- Step 2: placing the bristle-implanting brush head 2 in a material-loading trough of a paintbrush processing device, and filling up a bristle container of the paintbrush processing device with the bristle material;
- Step 3: turning on a switch of the paintbrush processing device, selecting auto mode function, and allowing the machine to run;
- Step 4: when a driving shaft of the paintbrush processing device rotates to a position where the bristle-implanting brush head 2 is located, and the bristle-implanting brush head 2 is precisely facing a gripping jaw of a handle-loading mechanism, the handle-loading mechanism can place the bristle-implanting brush head 2 into the gripping jaw and the bristle-implanting brush head 2 can be tightly gripped by the gripping jaw, and at this time the bristle-implanting brush head 2 is located at a handle-loading station;

Step 5: when the driving shaft drives the bristle-implanting brush head 2 to rotate from the handle-loading station to a next station, detecting whether a bristle-implanting brush head 2 is present on the driving shaft, and if a handle is present then bristle implanting is carried out in the next station, and if a handle is not present, then no bristle implanting is carried out;

Step 6: setting the bristle material 6 at an opening of a bristle material-laying trough 4, pressing the bristle material 6 into the bristle material-laying trough 4 by a plastic block 5 which carries a metal plate 3, and tightly clamping the plastic block 5 and the bristle-implanting brush head 2 together via the metal plate 3;

Step 7: rotating the bristle material 6 to a bristle-shearing station and carrying out a first bristle-shearing of the bristle material, and after the first bristle-shearing of the bristle material 6 is completed, rotating the bristle material 6 again to an abrading station and carrying out abrading of the bristle material 6;

Step 8: after abrading of the bristle material 6 is completed, rotating the bristle material 6 to the bristle-shearing station, and carrying out a second bristle-shearing of the bristle material;

Step 9: after the second bristle-shearing of the bristle material 6 is completed, rotating the bristle-implanting brush head 2 to the handle-loading station again via the driving shaft, inserting a positioning column 10 of the handle 1 or the bristle-implanting brush head 2 into a positioning trough 11 of the bristle-implanting brush head 2 or the handle 1, and at this time the handle 1 and the bristle-implanting brush head 2 are combined together; and Step 10: releasing the handle and checking package.

What is claimed is:

1. An environmental-friendly paintbrush without bristle-implanting holes, comprising a handle; a bristle-implanting brush head; and a metal plate, the bristle-implanting brush head having one end provided with a bristle material-laying trough and another end being connected with the handle; a plastic block placed inside the bristle material-laying trough; and bristle material filled in an interstitial space between the plastic block and the bristle-implanting brush head; wherein the plastic block is formed with a metal-laying trough and the metal plate is set inside the metal-laying trough, two ends of the bristle material-laying trough being formed with metal slots formed inside the brush-implanting brush head, and two ends of the metal plate being slotted into the metal slots;

wherein the plastic block has a V-shaped cross section, and the plastic block has one end located at a bottom end of the bristle-laying trough and another end provided with the metal-laying trough, the metal-laying trough being "|" shaped in cross section.

2. The environmental-friendly paintbrush without bristle-implanting holes as claimed in claim 1, wherein the metal plate is provided with a sawtooth trough at two ends thereof.

3. The environmental-friendly paintbrush without bristle-implanting holes as claimed in claim 1, wherein the bristle-implanting brush head and the handle are made of plastic, and the bristle-implanting brush head and the handle are unitary in structure.

4. The environmental-friendly paintbrush without bristle-implanting holes as claimed in claim 1, wherein the handle is provided with a positioning column or a positioning trough, the bristle-implanting brush head is provided with a corresponding positioning trough or a corresponding positioning column, and the bristle-implanting brush head is snapped onto the handle via the positioning trough and the positioning column.

5. The environmental-friendly paintbrush without bristle-implanting holes as claimed in claim 4, wherein detent pieces are provided on the positioning column, the positioning column is in mating connection with the positioning trough via the detent pieces.

6. The environmental-friendly paintbrush without bristle-implanting holes as claimed in claim 5, wherein the bristle-implanting brush head is made of plastic, and the handle is made of plastic or wood.

7. The environmental-friendly paintbrush without bristle-implanting holes as claimed in claim 6, wherein the metal plate is selected from the group consisting of iron plate, steel plate, stainless iron and copper plate.

8. A method of processing an environmental-friendly paintbrush without bristle-implanting holes, wherein the method comprises the steps of:

Step 1: preparing a handle and a bristle-implanting brush head, and placing bristle material on one side of a machine;

Step 2: placing the bristle-implanting brush head in a material-loading trough of a paintbrush processing device, and filling up a bristle container of the paintbrush processing device with the bristle material;

Step 3: turning on a switch of the paintbrush processing device, selecting auto mode function, and allowing the machine to run;

Step 4: when a driving shaft of the paintbrush processing device rotates to a position where the bristle-implanting brush head is located, and the bristle-implanting brush head is precisely facing a gripping jaw of a handle-loading mechanism, the handle-loading mechanism places the bristle-implanting brush head into the gripping jaw and the bristle-implanting brush head is tightly gripped by the gripping jaw, and at this time the bristle-implanting brush head is located at a handle-loading station;

Step 5: when the driving shaft drives the bristle-implanting brush head to rotate from the handle-loading station to a next station, detecting whether a bristle-implanting brush head is present on the driving shaft, and if a handle is present then bristle implanting is carried out in the next station, and if a handle is not present, then no bristle implanting is carried out;

Step 6: setting the bristle material at an opening of a bristle material-laying trough, pressing the bristle material into the bristle material-laying trough by a plastic block which carries a metal plate, and tightly clamping the plastic block and the bristle-implanting brush head together via the metal plate;

Step 7: rotating the bristle material to a bristle-shearing station and carrying out a first bristle-shearing of the bristle material, and after the first bristle-shearing of the bristle material is completed, rotating the bristle material again to an abrading station and carrying out abrading of the bristle material;

Step 8: after abrading of the bristle material is completed, rotating the bristle material to the bristle-shearing station, and carrying out a second bristle-shearing of the bristle material;

Step 9: after the second bristle-shearing of the bristle material is completed, rotating the bristle-implanting brush head to the handle-loading station again via the driving shaft, inserting a positioning column of the handle or the bristle-implanting brush head into a positioning trough of the bristle-implanting brush head or the handle, and at this time the handle and the bristle-implanting brush head are combined together; and Step 10: releasing the handle and checking package.

* * * * *